US009523194B2

(12) United States Patent
Clear

(10) Patent No.: US 9,523,194 B2
(45) Date of Patent: Dec. 20, 2016

(54) REINFORCED BLOCKWORK CONSTRUCTION METHOD

(71) Applicant: WEMBLEY INNOVATION LIMITED, London (GB)

(72) Inventor: Liam Clear, London (GB)

(73) Assignee: WEMBLEY INNOVATION LIMITED, London (GB)

( * ) Notice: Subject to any disclaimer, the term of this patent is extended or adjusted under 35 U.S.C. 154(b) by 0 days.

(21) Appl. No.: 14/653,747

(22) PCT Filed: Dec. 17, 2013

(86) PCT No.: PCT/GB2013/053319

§ 371 (c)(1),
(2) Date: Jun. 18, 2015

(87) PCT Pub. No.: WO2014/096802

PCT Pub. Date: Jun. 26, 2014

(65) Prior Publication Data

US 2015/0300007 A1 Oct. 22, 2015

(30) Foreign Application Priority Data

| | | |
|---|---|---|
| Dec. 21, 2012 | (GB) | 1223274.0 |
| May 23, 2013 | (GB) | 1309301.8 |
| Nov. 14, 2013 | (GB) | 1320157.9 |

(51) Int. Cl.
*E04B 2/10* (2006.01)
*E04B 2/26* (2006.01)
(Continued)

(52) U.S. Cl.
CPC . *E04B 2/10* (2013.01); *E04B 2/26* (2013.01); *E04C 1/39* (2013.01); *E04C 5/06* (2013.01); *E04B 2002/0254* (2013.01)

(58) Field of Classification Search
CPC ..... E04B 2/10; E04C 5/06; E04C 1/39
(Continued)

(56) References Cited

U.S. PATENT DOCUMENTS 2,118,936 A * 5/1938 Malinovszky ..... E04B 2/42 52/259
2,627,176 A * 2/1953 Levy ..... E04B 2/42 52/223.7

(Continued)

FOREIGN PATENT DOCUMENTS

AU 663959 9/1993
DE 31 37 335 A1 4/1983

(Continued)

OTHER PUBLICATIONS www.itacanet.org/doc-archive-eng/contruction/conintro.pdf An Introduction to Cement & Concrete Adapted from the VITA Village Technology Handbook, Rural Building by John van Winden, 1986 and Hand Book of Gravity-Flow Water Sytems by T. Jordan, Sep. 1980.*

(Continued)

*Primary Examiner* — Babajide Demuren
(74) *Attorney, Agent, or Firm* — Baker & Hostetler LLP

(57) ABSTRACT

A method of forming a structure comprising reinforced concrete filled masonry units is provided. A hollow masonry unit is laid in a first course. The hollow interior of the masonry unit is filled with reinforced concrete so that the concrete overflows and is spread out across the upper surface of the masonry unit to form a bed joint. A further masonry unit may be laid upon the bed joint to form a second course. A header end of the masonry unit may be vertically slotted to allow the unit to be threaded transversely over pre-installed elongate reinforcements such as rebars.

19 Claims, 5 Drawing Sheets

(51) Int. Cl.
*E04C 1/39* (2006.01)
*E04C 5/06* (2006.01)
*E04B 2/02* (2006.01)

(58) Field of Classification Search
USPC ..... 52/415, 698, 699, 704, 745.09, 745.05,52/293.2, 293.1
See application file for complete search history.

(56) References Cited

U.S. PATENT DOCUMENTS 3,292,331 A * 12/1966 Sams ..... E04B 2/10 52/300
3,296,758 A * 1/1967 Knudsen Kirkkejner ..... E04B 2/10 52/223.7
3,691,708 A * 9/1972 Firnkas ..... E04B 1/681 52/251
3,717,967 A * 2/1973 Wood ..... E04B 2/54 52/259
3,968,615 A 7/1976 Ivany
4,272,940 A 6/1981 Nicolls
4,563,852 A * 1/1986 Achtenberg ..... E04G 23/04 52/293.2
4,726,567 A * 2/1988 Greenberg ..... E04B 2/16 256/19
4,953,332 A * 9/1990 Galloway ..... E04C 3/34 52/223.5
5,007,218 A * 4/1991 Bengtson ..... E04B 1/06 52/204.1
5,355,647 A * 10/1994 Johnson ..... E04C 1/41 52/223.5
5,379,562 A * 1/1995 Hohmann ..... E04B 1/0007 403/391
5,878,544 A * 3/1999 McKinnon ..... E04B 2/8629 52/293.2
6,195,955 B1 * 3/2001 Kostopoulos ..... E04B 2/26 52/583.1
7,448,179 B2 * 11/2008 Schieffer ..... B25B 9/00 52/379
2009/0013638 A1 * 1/2009 Clarno ..... E04C 1/395 52/745.09
2010/0107545 A1 * 5/2010 Montague ..... E04B 1/24 52/699
2011/0041447 A1 * 2/2011 Philipp ..... E04B 1/48 52/585.1
2015/0052837 A1 * 2/2015 Gomes ..... E04B 2/24 52/405.3

FOREIGN PATENT DOCUMENTS

DE 8900283 U1 4/1989
DE 102004030921 * 1/2006 ..... C04B 28/02
EP 0378217 B1 10/1995
GB 2469272 A 10/2010
JP 2002-339480 A 11/2002
WO 2008/015407 A1 2/2008
WO 2009/098446 A2 8/2009
WO 2009/147427 A2 12/2009
WO 2012/063074 A2 5/2012

OTHER PUBLICATIONS http://www.arpnjournals.com/jeas/research_papers/rp_2013/jeas_0613_901.pdf ARPN Journal of Engineering and Applied Sciences, vol. 8, No. 6, Jun. 2013.*
https://www.woarjournals.org/admin/vol_issue1/upload%20Image/IJGAES021610.pdf Properties of Different Grades of Concrete Using Mix Design Method, vol. 2, Issue 6, Dec. 2014.*

* cited by examiner

REINFORCED BLOCKWORK CONSTRUCTION METHOD

CROSS-REFERENCE TO RELATED APPLICATIONS

This application is a National Stage of International patent application PCT/GB2013/053319, filed on Dec. 17, 2013, which claims priority to foreign United Kingdom patent application No. GB 1223274.0, filed on Dec. 21, 2012, and priority to foreign United Kingdom patent application No. GB 1309301.8, filed on May 23, 2013, and priority to foreign United Kingdom patent application No. GB 1320157.9, filed on Nov. 14, 2013, the disclosures of which are incorporated by reference in their entirety.

FIELD OF THE INVENTION

This invention relates to a simplified method of forming structures from assemblages of hollow blocks (for example hollow concrete blocks or like building units), some or all of which are placed around steel rebars or around similar elongate reinforcements, or have such reinforcements placed within their hollow interiors, the hollow interior space then being filled with wet or semi dry concrete, which when cured forms a reinforced concrete core within the blockwork. This construction method may be used for example to form blockwork clad, reinforced concrete columns, which may be used as a replacement for a wind post in a blockwork infill in a pre-existing load bearing building structure, as disclosed in our patent specifications WO2009/098446 and WO2012/063074. However the construction method is of more general applicability.

BACKGROUND

WO2012/063074 describes building a column of stack bonded hollow concrete blocks which are filled with reinforced concrete to form a reinforced concrete core. A cleat is fixed to a foundation, floor slab, beam or like pre-existing load bearing structure in a position at the base of where it is desired to erect the column. Bolts, expansion bolts or other appropriate fasteners are used for such fixing, passing through holes in a base plate of the cleat. A pair of terminal rebars is then fitted to the cleat by engaging tubular sockets welded to their ends over a corresponding pair of spigots upstanding from the cleat base plate. A bed of mortar or like jointing material is spread around the base of the cleat. A hollow block is then laid in the mortar in the correct position to form the first course of encasing masonry for the column. The upper rim of the block just laid is spread with a layer of mortar and the next block is laid in stack bond on top of it. Further blocks are laid similarly in succession until only just sufficient length of each terminal rebar protrudes above the top block to form a lap joint with a length of plain rebar (or other elongate reinforcement) which is to be joined to the projecting rebar upper end. Once the lap joints have been secured e.g. by wire ties or the like, further hollow blocks can be laid in stack bond, threaded over the tops of the plain rebars. Further lengths of plain rebar (or other elongate reinforcement) can be secured by lap joining until the desired height of the column is reached. The cavity enclosed by the stacked hollow blocks can be filled with concrete or other cementitious material at suitable intervals as block laying progresses. If desired, alternate courses may be formed using two separate halves of a hollow block, so that the pointing pattern of the column blends with that of an adjacent panel of blockwork, apart from the discontinuity formed by an expansion joint interposed between the column and the panel. Additionally or alternatively, one or both sides of the reinforced concrete filled blockwork column may be keyed/bonded to the adjacent blockwork panel; adjacent courses of blocks being laid in staggered relationship with each other, e.g. so that a stretcher bond pattern in the panel extends into the reinforced concrete filled column. Such structures are described in WO2009/098446.

These building methods require skilled labour to carry them out. A particular difficulty arises when thin walled blocks are used, as is preferred, in order to maximise the cross-section and hence the strength of the reinforced concrete core of the blockwork column. The upper rim of such hollow blocks is quite narrow (as little as 20 mm wide) and it is therefore difficult to spread an even layer of mortar on this rim, upon which to lay the next block to form the column. Mortar is easily dislodged or dropped into the hollow interior of the column. This not only is a waste of mortar, but may also contaminate and weaken the reinforced concrete filling or its bond to the foundation. A supplementary problem arises in that every block used to form the column must be lifted over the upper ends of the rebars and then treaded back down the rebars to its final position. This extra lifting and lowering of masonry units is physically demanding. Joining successive lengths of rebar as the height of the column increases is also rather time consuming.

SUMMARY OF THE INVENTION

The present invention aims to mitigate these problems by providing a method of forming a structure comprising reinforced concrete or cemetitious material filled masonry units, comprising laying a hollow masonry unit in a first course; filling the hollow interior of the masonry unit with reinforced concrete or cemetitious material so that the concrete overflows and is spread out across the upper surface of the masonry unit to form a bed joint, and laying a further masonry unit upon the bed joint in a second course. The exposed edges of the bed joint concrete can be pointed in the usual way to provide a neat appearance to the finished bed joint.

Preferably the reinforced concrete comprises an elongate reinforcement extending between the hollow interiors of the masonry units in the first and second courses. The method may comprise installing the elongate reinforcement through the full height of the eventual structure, before laying the hollow masonry unit in the first course. The elongate reinforcement may comprise a rebar. A lower end of the elongate reinforcement may be bonded, e.g. using synthetic resin, such as epoxy resin, into a hole drilled into a foundation, floor slab or beam. The upper end of the elongate reinforcement may be slidably inserted into a socket forming part of a cleat secured to a soffit. Alternatively the upper end of the elongate reinforcement may comprise a sleeve into which a spigot forming part of a cleat secured to a soffit is inserted. Preferably a clearance is left between the upper end of the elongate reinforcement at the bottom of the sleeve and the tip of the spigot, or between the upper end of the elongate reinforcement and the inner end of the cleat socket, to allow for relative movement between the soffit and the top of the masonry structure. The rebars may be installed by drilling the holes in the foundation or the like, sufficiently deep to allow the top end of the elongate reinforcement to lie below and clear of the cleat. The rebar can then be raised so that its upper end overlaps and extends into/over the cleat to the required extent, and be supported in this position while the bonding material cures in the hole. Alternatively a cleat can be used to secure the lower end of the elongate reinforcement to the foundation, floor slab or beam. The elongate reinforcement may comprise a single continuous length of rebar, or may comprise a plurality of rebar lengths joined end to end by suitable sleeve couplings, or connected together by lap joints.

The wall of the hollow masonry unit may comprise a through-going vertical slot, enabling it to be placed laterally around the elongate reinforcement without having to be lifted over a free upper end of the elongate reinforcement and then lowered into position. This not only eliminates the lifting/lowering effort otherwise required, but also allows a complete length of reinforcement to be pre-installed between for example a foundation or the like and a soffit or the like. Block laying can therefore proceed as a continuous operation, without requiring intervention of a different trade for installation of fresh rebar.

For optimum strength, the concrete preferably comprises aggregate having the largest maximum grain size compatible with a given bed joint thickness. For example, with 10 mm thick bed joints, the concrete mixture may comprise approximately one part modified Portland cement including a plasticiser, to approximately one part grit or pea gravel of maximum 6 mm approximate grain size, to one part fine soft sand. Alternatively in some cases sharp sand may be preferred if this improves the strength of the cured concrete or cementitious material, albeit possibly at the expense of reduced workability of the material in its role as a mortar.

Illustrative embodiments of the invention and their preferred features and advantages are described below with reference to the drawings, in which:

DETAILED DESCRIPTION

Figure 1:
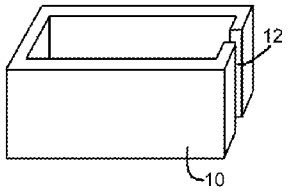
FIG. 1 is a perspective view of a hollow cement block which may be used to form structures in embodiments of the method of the invention.

FIG. 1 shows a hollow concrete block 10 suitable for implementing embodiments of the method of the present invention. The block may be of standard external dimensions, but has relatively thin walls, e.g. of only 20 mm thickness, so as to maximise the internal space available to accommodate reinforced concrete, as further described below. One header end of the block has a vertical slot 12 cut through the entire thickness of the wall, enabling the block 10 to be threaded laterally over rebars or similar elongate reinforcements. For example, the slot may be 20 mm wide to allow easy passage of 16 mm nominal diameter rebars (also allowing for the usual rebar surface ribs).

Figure 2:
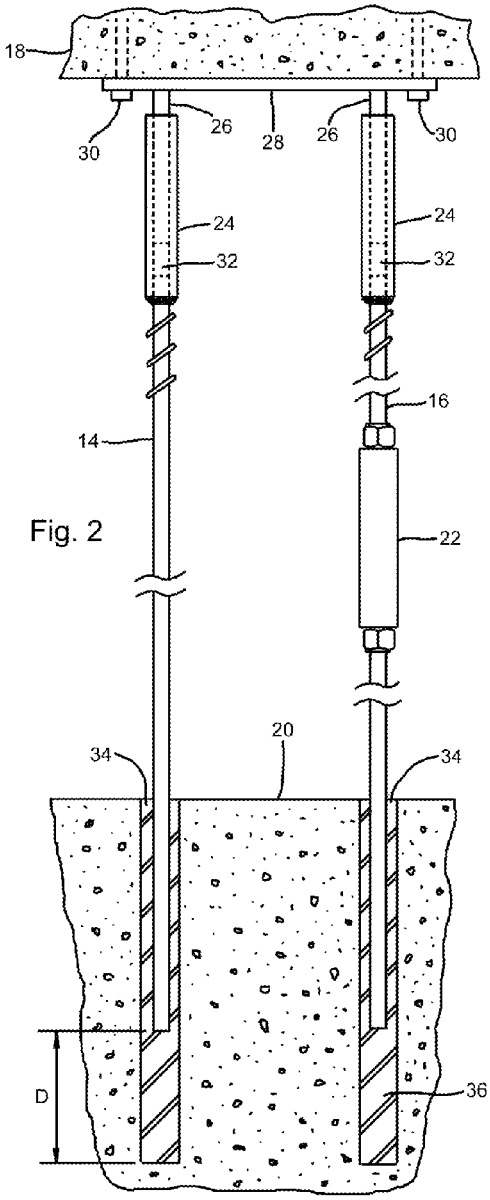
FIG. 2 shows, in part cross-section, a pair of rebars installed between a soffit and a foundation, forming a first stage in carrying out a construction method embodying the invention.

FIG. 2 shows a pair of parallel rebars 14, 16, installed between a soffit 18 and a foundation 20. The rebars 14, 16, are used to provide the reinforcement in a reinforced concrete filled, stack bonded masonry column formed in accordance with an embodiment of the invention. The rebars may comprise a single continuous length of steel (see rebar 14) or may be formed from separate lengths joined together by suitable connectors 22, such as GEWI (RTM) couplers available from Dywidag-Systems International Ltd., Northfield Road, Southam, Warwickshire CV47 0FG, UK (see rebar 16). Such installation can be completed before masonry laying commences. The upper ends of the rebars carry respective welded-on sleeves 24, in which downwardly projecting spigots 26 of a cleat 28 are slidably received. The cleat is secured to the soffit 18 by suitable fasteners, such as expansion bolts 30. The tips of the spigots 26 are spaced from the ends of the rebars 14, 16 within the sleeves 24 to leave movement gaps 32, which can accommodate relative movement between the top of the masonry column and the soffit 18. Alternatively, the cleat 28 may be omitted and the rebar ends simply inserted into holes drilled vertically into the soffit (not shown). The holes are drilled somewhat "overdepth" and the inserted rebars are supported with their upper ends clear of the top (inner) ends of the holes, to provide a movement gap analogous to the gap 32 existing when the cleat 28 is used.

Figure 2A:
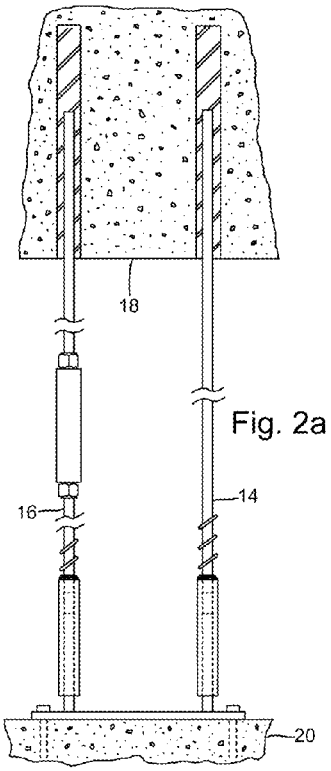
FIG. 2*a* corresponds to FIG. 2 but is drawn to a smaller scale and shows an alternate configuration of the installed rebars.

Yet alternatively, the cleat may comprise tubular sockets (not shown) in which the upper ends of the rebars are slidably received, again preferably with movement clearance. The lower ends of the rebars 14, 16 are grouted into holes 34 drilled into the foundation 20, using a suitable high strength grout 36, such as epoxy resin. The holes include sufficient clearance depth D below the lower ends of the rebars in their final position, to enable the rebar upper end sleeves 24 to be engaged over the spigots 26 or into the sockets of a socketed cleat or into the soffit holes if no cleat is used. Such a clearance depth may not be necessary in the case of multi-part rebars such as 16. Yet alternatively, a cleat may be used to secure the lower ends of the rebars to the foundation 20 and the upper ends may be received in holes drilled in the soffit 18, as shown in FIG. 2*a*. Only the upper, lower and joint sections of the rebars are shown in FIG. 2 or FIG. 2*a*. The rebars will typically have a length of several meters, e.g. corresponding to the height of a storey in a building.

Figure 3:
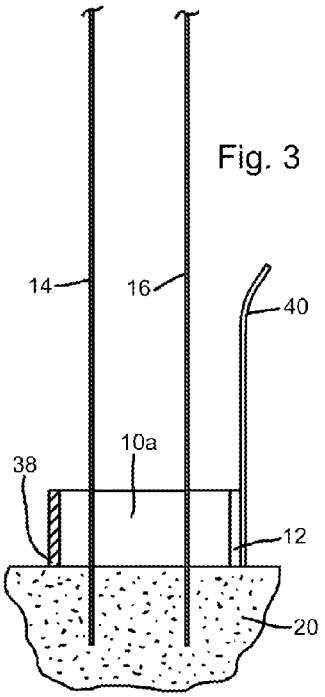
FIG. 3 a cross-sectional view which shows a subsequent stage in carrying out the construction method, with a first hollow block laid to form a first course.

Masonry laying commences by spreading on the foundation around the base of the rebars 14, 16, a layer 38 (FIG. 3) of the concrete or cementitious material mix which will also be used to fill the hollow masonry blocks. Because this mix is to be effectively used as a mortar, it will typically comprise a cement containing plasticisers and possibly other workability and cure time control additives. Specialist cements for such purposes are available from Parex Ltd., Holly Lane Industrial Estate, Atherstone, Warwickshire CV9 2QZ, UK; or from CPI Mortars Limited, Willow House, Strathclyde Business Park, Bellshill, Motherwell, Scotland ML4 3PB, for example. The maximum grain size of the aggregate used to form the cementitious material mix has to be less than the thickness of the masonry joints but preferably is otherwise kept as high as possible, so as to produce a high strength reinforced concrete filling for the column. Hence also a relatively rich mix is preferred, e.g. 1:1:1 modified Portland cement: aggregate: sand. The aggregate may be pea gravel or grit with a 6 mm maximum grain size. The layer 38 forms a bed in which a first hollow block 10*a* forming the first course of a stack bonded column is laid. Slot 12 enables the block 10*a* to be threaded laterally over the rebars 14, 16 and centralised around them. A strip of expansion joint filler material 40, e.g. Corofil (RTM) or the like may be supported against the header face of the block 10*a* containing the slot 12, so as to seal this slot. The support for the strip 40 may be provided by additional masonry (not shown) e.g. a wall panel which is being built at the same time as the column. However when the concrete or cementitious material mix is prepared semi-dry, containing only just sufficient water for workability and curing, this produces a stiff mix which is self-supporting and will therefore not be extruded through the slot 12 even if multiple courses of blocks are back filled with uncured mix in a single operation. The slot 12 is preferably kept as narrow as possible (consistent with allowing the blocks to be threaded over the rebars 14, 16) so as to be more effective in retaining the semi-dry concrete or cementitious material mix. Any fixtures which may be required to secure the wall panel to the rebars 14, 16 within the column, e.g. as described in WO2012/063074, are preferably installed at approximately the correct height(s) on the rebars, before masonry laying commences. Conventional metal ties may be incorporated into the column bed joints at appropriate intervals, such that one half of each tie lies in the column bed joint and another half of each tie lies in a bed joint of the adjacent masonry panel, to tie the panel and column together across the vertical joint between them. Additionally or alternatively, special ties may be used as further described below with reference to FIGS. 13-16.

Figure 4:
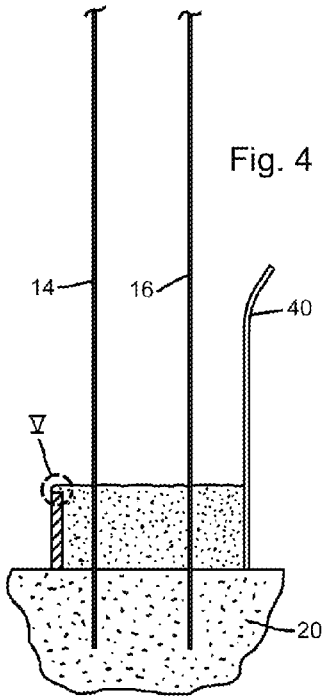
FIG. 4 corresponds to FIG. 3, but shows a subsequent stage, with the first hollow block filled with wet concrete.
Figure 6:
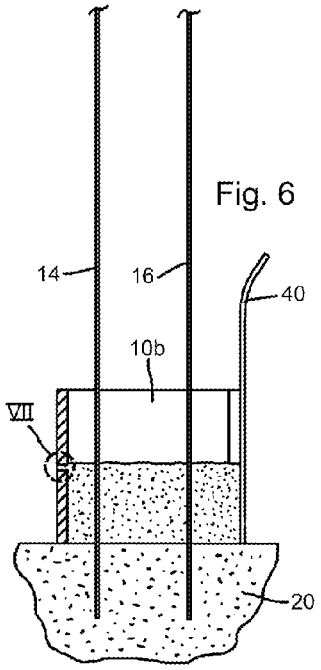
FIG. 6 corresponds to FIG. 4, but shows a subsequent stage with a second hollow block laid to form a second course.
Figure 5:
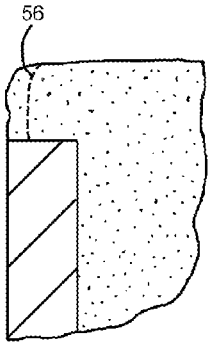
FIG. 5 is a detailed view of a part of FIG. 4.
Figure 7:
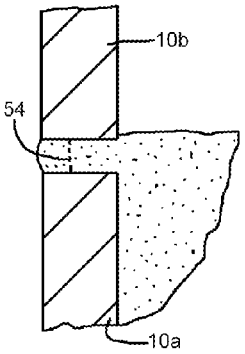
FIG. 7 is a detailed view of a part of FIG. 6, corresponding to the part shown in FIG. 5.
Figure 8:
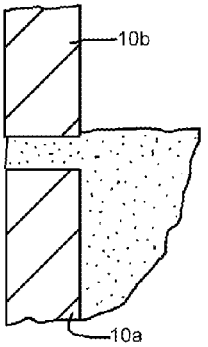
FIG. 8 corresponds to FIG. 7, but shows a subsequent stage.

The hollow interior of the block 10*a* is then filled with the uncured cementitious mix, to a level about 12-15 mm higher than the top rim of the block (see FIG. 4). The still plastic mixture is spread out to cover the upper edge of the block, as shown in portion V of FIG. 4, reproduced on a larger scale in FIG. 5. A second block 10*b* may then be laid on this layer, to form a second course of the stack bonded column, as shown in FIG. 6. As the block 10*b* is tamped into position, a bead of the concrete mixture is extruded out from between the adjacent edges of the blocks 10*a*, 10*b*, as shown in region VII of FIG. 6 (shown on an enlarged scale in FIG. 7). The extruded concrete may be pointed in the conventional way (e.g. as shown in FIG. 8). No separate bead of mortar needs to be applied to the rim of block 10*a*, eliminating the danger of mortar contamination of the concrete filing and reducing the bricklaying skills required.

Figure 9:
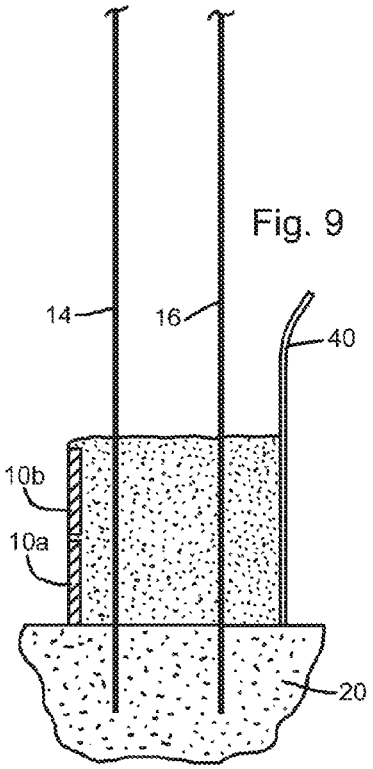
FIG. 9 corresponds to FIG. 6, but shows a subsequent stage, in which the second hollow block is filled with wet concrete.
Figure 10:
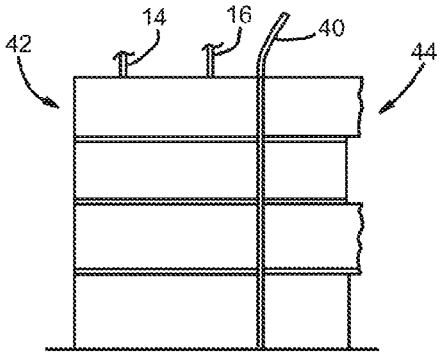
FIG. 10 is a side view of a subsequent stage in carrying out the method, in which four courses of a stack bonded hollow cement block column filled with reinforced concrete have been laid.

The interior of block 10*b* may then be filled with concrete/cementitious material which also forms a bed joint layer spread out over the upper edge of block 10*b*, in the same way as for block 10*a* (see FIG. 9). The process can be repeated to add as many blocks (courses) to the stack bonded column as are desired. Once the filling has cured, it encases and is reinforced by the rebars 14, 16. It also fills the bed joints between adjacent blocks 10. FIG. 10 shows a partially built, stack bonded, reinforced concrete filled masonry column 42, with the expansion joint strip 40 built-in between the column and the edge of an adjacent masonry wall panel 44 being constructed at the same time.

Figure 11:
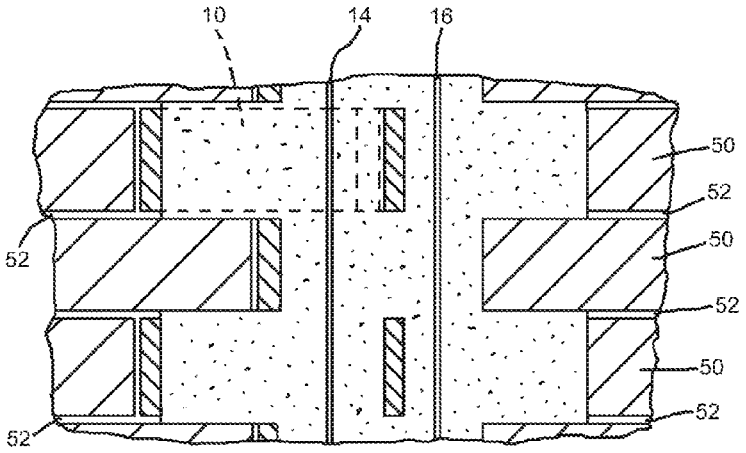
FIG. 11 is a cross-sectional view of part of a wall structure formed by a second embodiment of the method of the invention.
Figure 12:
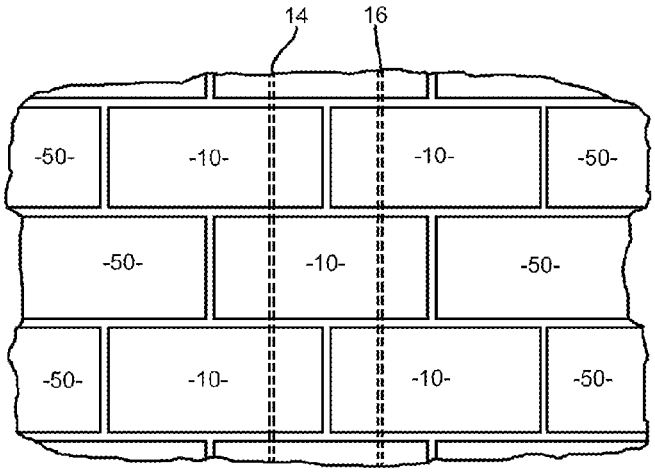
FIG. 12 is a front view of the same part of the wall as is shown in FIG. 11.

The hollow blocks 10, filled with concrete/cementitious material which also is used to form the bed joints between adjacent courses, the blocks preferably being slotted so as to allow them to be threaded laterally over rebars to be embedded in the filled block interiors, can be used to form other structures besides stack bonded columns. For example, as shown in FIG. 11, alternating courses of one and two hollow blocks are laid in staggered fashion to form a stretcher bond pattern, and this pattern is continued into adjacent panels of solid masonry blocks 50 built up simultaneously with and on either side of the column of hollow blocks 10. An illustrative upper left hollow block 10 is shown in dotted outline in FIG. 11. The joints 52 between neighbouring solid blocks 50 may be filled with the same mixture as used to fill the hollow blocks, or may be filled with conventional mortar, preferably colour matched to the concrete/cementitious material used to form the column, if aesthetics of the finished structure are important. The reinforced concrete or cementitious material filled, hollow block column is thus keyed to the adjacent panels of solid masonry, by the continuous stretcher bond pattern. As apparent from FIG. 12, the reinforced blockwork column, which serves to strengthen the complete masonry structure, is indistinguishable from the surrounding solid blockwork, when viewed from the outside. Rather than the cementitious bedding/fill material simply being pointed in as described above with reference to FIG. 8, the bedding material can be allowed to part cure or cure and then be raked out, e.g. back to the dotted line 54 in FIG. 7, prior to final pointing using the same mortar as the rest of the wall panel. In this case, the bedding/fill material may not be spread right up to the edge of the lower block before laying the next block, as indicated by the dotted line 56 in FIG. 5. Rather than using solid blocks, the unreinforced portions of the masonry structure could also be built from hollow or cellular blocks 10, preferably without a header end slot 12. Mortar dropping/contamination is not as critical in these areas of the structure, so the thin edges available for receiving bed joint mortar are not as problematic in these unreinforced regions. A sleeve may be slid over the vertical rebars to facilitate a junction interface connection detail with horizontal bond beams, and/or other connection details, as may be required; e.g. as shown and described in WO2012/063074, WO2009/147427, WO2009/098446 and WO2008/015407.

Figure 13:
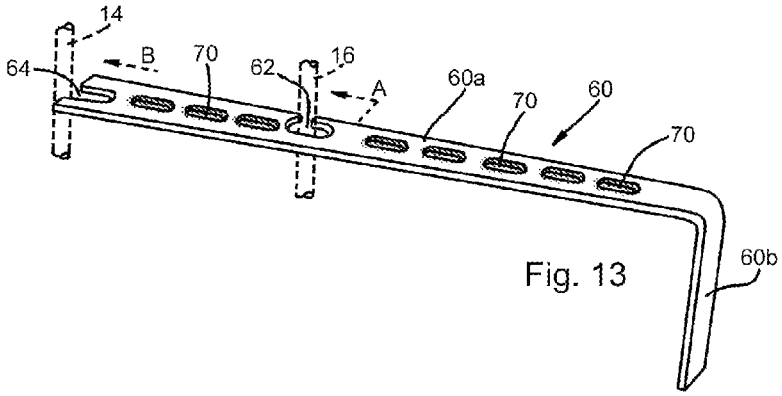
FIG. 13 shows a special form of tie bracket used to secure a stack bonded column to an adjacent masonry panel where no movement joint is to be provided.

FIG. 13 shows a bracket 60 formed from a strip of metal such as steel, bent into an L-shape. Part way along the length of a longer limb 60*a* of the bracket, an L-shaped slot 62 is formed, having a mouth lying at one edge of the strip. A longitudinal slot 64 is formed at the free end of the bracket longer limb 60*a*, having a mouth lying at one end of the strip. The longer limb 60*a* may thus be engaged over the vertical rebar 16 reinforcing a stack bonded column, by moving the bracket rearwardly and then to the left as indicated by arrow A in FIG. 13, so that rebar 16 fully enters the slot 62. The bracket can be simultaneously engaged with the other vertical rebar 14 reinforcing the column, by movement in the direction of arrow B, so that rebar 14 enters the slot 64. The stack bonded column may be similar to column 42, FIG. 10, but without the expansion joint 40.

Figure 14:
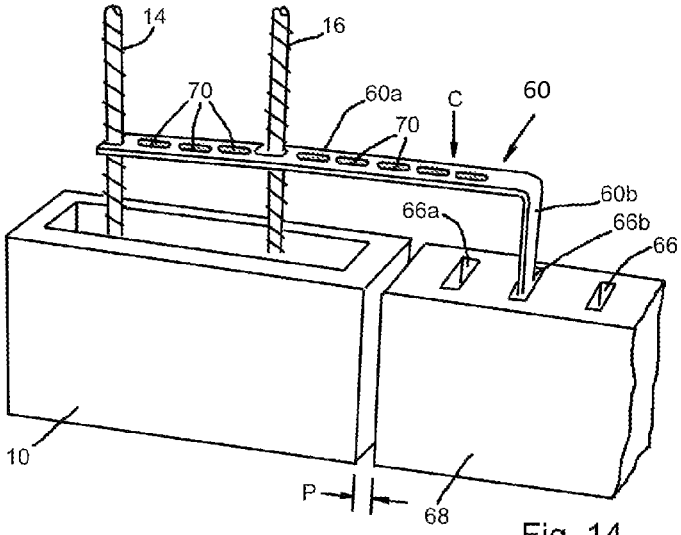
FIG. 14 shows the bracket of FIG. 13 being fitted to the column reinforcing bars.
Figure 15:
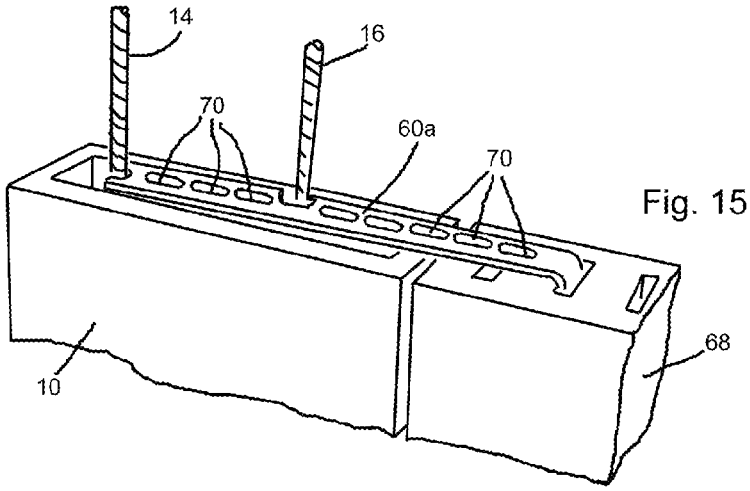
FIG. 15 shows the bracket of FIG. 13 in a final position, prior to being built into the column and masonry panel.

The bracket 60 is then lowered along the rebars 14, 16 in the direction of arrow C, until its shorter limb 60*b* enters a vertical slot 66 formed in a block 68 which has been laid as part of the adjacent masonry panel (FIG. 14). The slotted block 68 may be as shown and described in GB2469272. The bracket limb 60*a* is dimensioned so that the limb 60*b* is aligned to enter one of the slots 66 in the block 68 when the limb 60*a* is properly engaged with the rebars 14, 16 which are in turn properly centred within hollow block 10, which in turn is at the correct perpend spacing P from the block 68. For added strength of the tied connection arising from use of the bracket 60, it is preferred that the limb 60*b* does not enter the endmost slot 66*a* in block 68, but instead enters the second (or a subsequent) slot away from the end, such as slot 66*b* as shown in FIG. 14. The bracket 60 finally comes to rest with its longer limb 60*a* resting on the upper rim of the hollow column block 10 and on the upper surface of the slotted block 68 (FIG. 15). The bracket longer limb 60*a* is provided with through holes 70 by which it is keyed into the cementitious material within the column and into the mortar bed joint of the adjacent masonry panel. In the completed structure, the bracket 60 serves to tie the column and adjacent masonry panel together without a movement joint between them.

Figure 16:
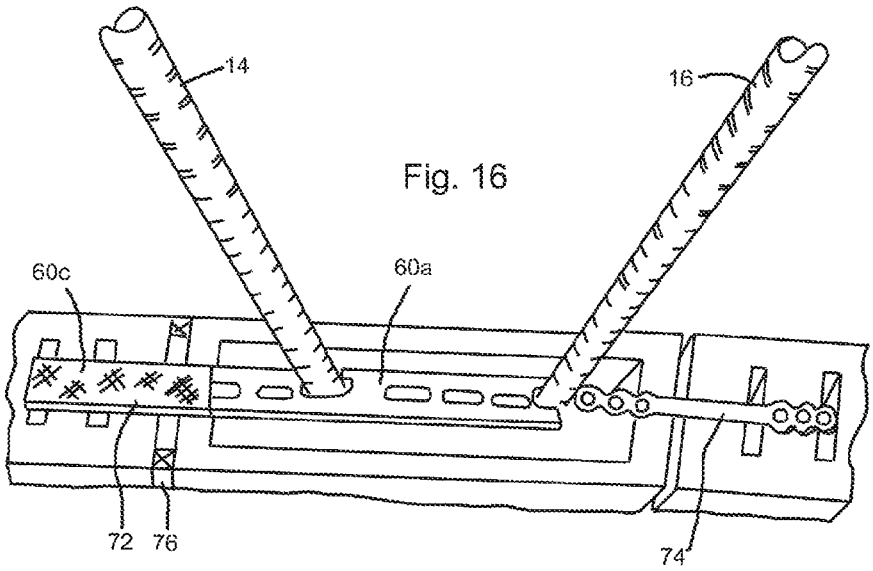
FIG. 16 is a perspective view from above showing a modified form of the bracket of FIGS. 13-15 being used to secure a stack bonded column under construction to a masonry panel on one side, and a conventional tie being used to secure the column to a masonry panel on the other side.

To allow horizontal longitudinal movement of the panel relative to the column while still resisting transverse relative movement (shear movement) between the column and panel, and/or resisting bending moments arising from bowing of the panel, the shorter limb 60*b* of the bracket may be omitted or remain unbent. In that case, the portion of the bracket 60*c* extending into the masonry panel may be provided with a movement sleeve 72 of a suitable material such as metal, plastics or a sealant-impregnated fabric wrapping, to be built into the bed joint, as shown in FIG. 16. The sleeve covers the end 60*c* of the bracket at least as far as the movement joint 76. Absent such brackets 60 a conventionally tied block panel, or a block panel without any ties (e.g. secured to the column by means of a bond beam as disclosed in WO2009/098446 or WO2012/063074), may be regarded as simply supported at its edges, i.e. the edge joint effectively provides no resistive bending moment. A conventional tie 74 of this kind is shown on the opposite side of the column from the bracket 60*a* in FIG. 16, for use without any movement joint between the column and the adjacent masonry panel on that side. The joint allows rotation and all or a substantial majority of the bending moment generated by the applied loads increases from substantially zero at the panel edge to a peak at the mid panel position. By introducing the heavy tie bracket 60 with the spigot/slot connection 60*b*/66*b* or a movement sleeve connection 60*c*/72 into the block work panel and with full embedment 60*a* into the adjacent column, it is possible to generate some resistance to rotation, i.e. a negative bending moment at the panel edge which reduces the peak bending moment by around 35%. Consequently, the allowable panel size may be increased for a given lateral load, requiring fewer columns to be used.

The invention claimed is:

1. A method of forming a structure comprising concrete or cementitious material filled masonry units, comprising laying a hollow masonry unit in a first course; filling the hollow interior of the masonry unit with concrete or cementitious material so that the filler material overflows and is spread out across the upper surface of the masonry unit to form a bed joint, and laying a further masonry unit upon the bed joint in a second course, wherein the concrete or cementitious material filling comprises a reinforcement.

2. The method of claim 1, in which the reinforced concrete or cementitious material comprises an elongate reinforcement extending between the hollow interiors of the masonry units in the first and second courses.

3. The method of claim 2, comprising installing the elongate reinforcement through the full height of the eventual structure, before laying the hollow masonry unit in the first course.

4. The method of claim 2, wherein a lower end of the elongate reinforcement is bonded into a bottom hole drilled into a foundation, floor slab or beam.

5. The method of claim 4, wherein the hole in the foundation, floor slab or beam is sufficiently deep to allow the top end of the elongate reinforcement during installation to lie below and clear of a soffit hole or a cleat secured to a soffit and to be extended to engage the soffit hole or cleat before bonding the lower end of the elongate reinforcement into the bottom hole.

6. The method of claim 2, wherein a cleat is used to secure the lower end of the elongate reinforcement to a foundation, floor slab or beam.

7. The method of claim 2, wherein the upper end of the elongate reinforcement is slidably inserted into a socket forming part of a cleat secured to a soffit.

8. The method of claim 2, wherein the upper end of the elongate reinforcement comprises a sleeve into which a spigot forming part of a cleat secured to a soffit is inserted.

9. The method of claim 2, wherein the upper end of the elongate reinforcement is inserted into a hole drilled into a soffit.

10. The method of claim 2, wherein the elongate reinforcement comprises a single continuous length of rebar.

11. The method of claim 2, wherein the elongate reinforcement comprises a plurality of rebar lengths joined end to end.

12. The method of claim 1, wherein a wall of the hollow masonry unit comprises a through-going vertical slot through which the elongate reinforcement may pass laterally into the hollow interior of the masonry unit.

13. The method of claim 1, wherein the concrete or cementitious material comprises aggregate having a largest maximum grain size compatible with a given bed joint thickness.

14. The method of claim 13, wherein the concrete or cemetitious material comprises aggregate having a maximum grain size of approximately 6 mm.

15. The method of claim 1, wherein the concrete or cementitious material mixture comprises approximately one part modified Portland cement including a plasticiser, to approximately one part grit or pea gravel to one part fine sand.

16. The method of claim 1, comprising installing a bracket which is embedded in the cementitious material and in a bed joint of an adjacent masonry panel.

17. The method of claim 16, wherein the bracket is mechanically engaged with an elongate reinforcement extending between the hollow interiors of the masonry units in the first and second courses.

18. The method of claim 16, wherein the bracket comprises a movement sleeve which is built into a bed joint of a masonry panel constructed adjacent to the reinforced concrete or cementitious material filled masonry units.

19. The method of claim 16, wherein the bracket comprises a limb engaged in a slotted block which forms part of a masonry panel constructed adjacent to the reinforced concrete or cementitious material filled masonry units.

* * * * *